US005140790A

United States Patent [19]

Modglin et al.

[11] Patent Number: 5,140,790

[45] Date of Patent: Aug. 25, 1992

[54] DOME-SHAPED STRUCTURE

[75] Inventors: Rodger L. Modglin; John C. Calvert, both of Tulsa, Okla.

[73] Assignee: Nordam, Tulsa, Okla.

[21] Appl. No.: 584,599

[22] Filed: Sep. 19, 1990

[51] Int. Cl.[5] ..... E04H 3/00

[52] U.S. Cl. ..... 52/80; 52/82; 52/71; 52/72; 52/64

[58] Field of Search ..... 52/64, 66, 67, 71, 72, 52/80, 82

[56] References Cited

U.S. PATENT DOCUMENTS 2,151,234 3/1939 Rutten et al. ..... 52/82
2,280,206 4/1942 Waller et al. .
2,735,818 7/1956 Green .
3,420,605 1/1969 Kipping .
3,992,841 11/1976 Ward .
4,473,355 9/1984 Pongratz .
4,514,347 4/1985 Reed .
4,631,867 12/1986 Reed .
4,642,945 2/1987 Browning et al. .
4,750,807 6/1988 Chamayou Dit Felix .

*Primary Examiner*—David A. Scherbel
*Assistant Examiner*—Lynn Wood
*Attorney, Agent, or Firm*—Head & Johnson

[57] ABSTRACT

A dome shaped structure, and the method of constructing it, are described using curved gore-shaped construction panels which have grooves in their side edges. Rectangular tubular joining members are placed in the grooves, secured therein, and serve to join adjacent panels together. This provides a level surface where the panels are joined so that such adjacent edges of joined panels are even making the interior surface suitable for use as a projection surface.

11 Claims, 3 Drawing Sheets

DOME-SHAPED STRUCTURE

BACKGROUND OF THE DISCLOSURE

1. Field of the Invention

This invention relates to dome-shaped structures and the joints used to attach curved panels together to form such dome-shaped structures.

The use of dome-shaped structures for projection screens, planetaria, theaters, and the like is well known. However, one problem with dome-type structures is the formation of a smooth, even edge between panels where they join together. Various types of joints have been employed, such as overlapping edges, chamfered edges, joining by a T-shaped bar, and the like, all produce uneven edges. Another consideration is whether the dome-structure is to be static or dynamic. Today, many dome-shaped structures are used as flight simulators, navigational training simulators, and similar uses. Such uses employ a static structure or a dynamic structure mounted on a moveable base. Either type of structure requires strength and resiliency. This disclosure provides both the needed strength for a dynamic structure and an even edge surface at the joint areas of abutting panels which is suitable for a projection surface.

2. Disclosure Statement

A search of the field disclosed the following U.S. Patents:

| | | |
|---|---|---|
| 2,280,206 | 04/21/42 | Waller et al |
| 2,753,818 | 07/10/56 | Green |
| 3,420,605 | 01/07/69 | Kipping |
| 3,992,841 | 11/23/76 | Ward |
| 4,473,355 | 09/25/84 | Pongratz |
| 4,514,347 | 04/30/85 | Reed |
| 4,631,867 | 12/30/86 | Reed |
| 4,642,945 | 02/17/87 | Browning |
| 4,750,807 | 06/14/88 | Chamayou dit Felix |

Waller describes a dome-shaped theater, but is more concerned with the location of the projectors and sound equipment, and does not detail how the dome is constructed. Green discloses a dome shaped structure for projection purposes and addresses the problem of a smooth projection surface. Green achieves this by using a partial vacuum to support the projection surface. Kipping discloses the use of wide-angle photography which can be projected, externally, on a semi-translucent dome-shaped screen. The Kipping disclosure also uses either a positive or negative pressure to support the screen. The Ward patent addresses the problem of how to form even edges where prefinished curved panels are attached by using a tapered/chamfered overlapping joint. The Pongratz disclosure also uses a pressure supported screen and external projectors and is static. The Reed patent ('347) teaches how to form a smooth inner surface in a geodesic dome structure using a pivotal cutting tool to smooth the surface. The second Reed ('867) patent is a divisional patent and uses the same method to produce a smooth surface. The Browning patent is the only one described as being on a movable base. Browning uses a frame composed of ribs or other structural elements with a film screen supported by negative pressure or by ties. Chamayou dit Felix discloses a dome-structure composed of joined polygonal elements and overlapping edges.

None of the references shown the means or method of joining construction panels described and claimed by this application.

SUMMARY OF THE INVENTION

This invention relates to a dome-shaped structure which is made of curved, gore-shaped, construction panels having grooves in their edges. The panels are joined by inserting a joining member in the grooves of adjacent panels and fastened therein thus joining the adjacent panels together. The method of joining produces eve, aligned edges on adjacent panels suitable for use as a projection surface, or for applying a presentation surface thereon. The joints of this disclosure are placed along the entire length of each side of each curved panel and provide exceptional strength to the structure. This strength is vertical, as well as horizontal, and helps to keep the dome from "bowing" under its weight. The method of constructing the dome structure is dimple and rapid. The structure may be entirely prefabricated.

DESCRIPTION OF THE PREFERRED EMBODIMENT

Figure 1:
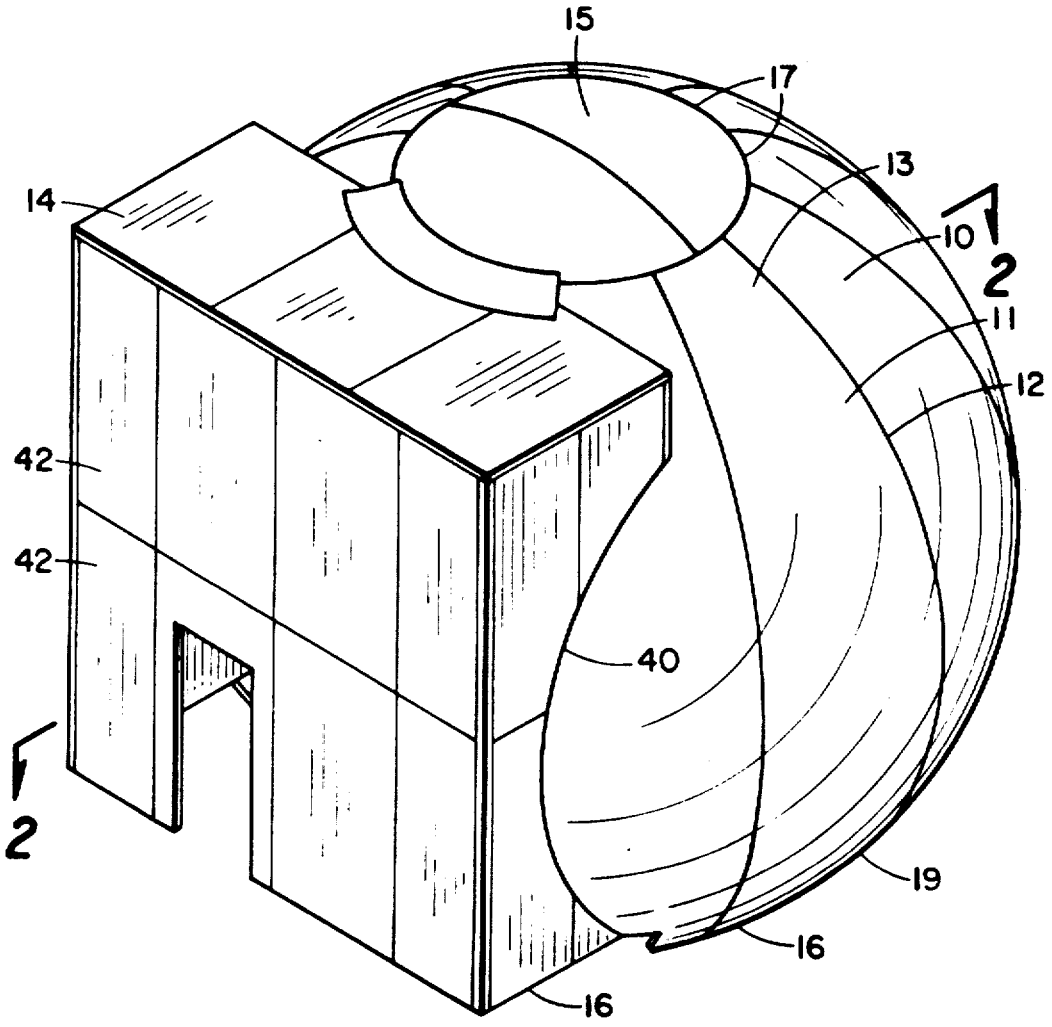
FIG. 1 is an isometric view of the dome structure of this disclosure with an attached rectangular structure.

FIG. 1 illustrates a dome-shaped structure suitable for use as a projection structure, simulation structure, or the like. The dome, which is usually spherical and is generally indicated by the numeral 13, has a plurality of gore-shaped panels 10 and 11 which are joined together at seams 12. When a plurality of such panels 10 and 11 are so joined, they form a structure 13 which resembles the external surface of a peeled orange with its numerous gore-shaped segments.

In the preferred embodiments illustrated in FIG. 1, the joined panels 10 and 11 have truncated top ends 17 which are fitted to a cap piece 15. A lower truncated end 19 is present at the opposite end of the panels 10 and 11 and attaches to the base 16 of the structure. This embodiment also has a rectangular building 14 attached to the dome 13. This rectangular building 14 may be used as an entrance, projector area, or other such use. In this embodiment, we have used a diameter of twenty-four feet for the dome.

The base 16 of dome 13 and of rectangular building 14 may be mounted on a moveable base or hydraulic actuator (not shown), suitable for moving or tilting the structure.

Figure 2:
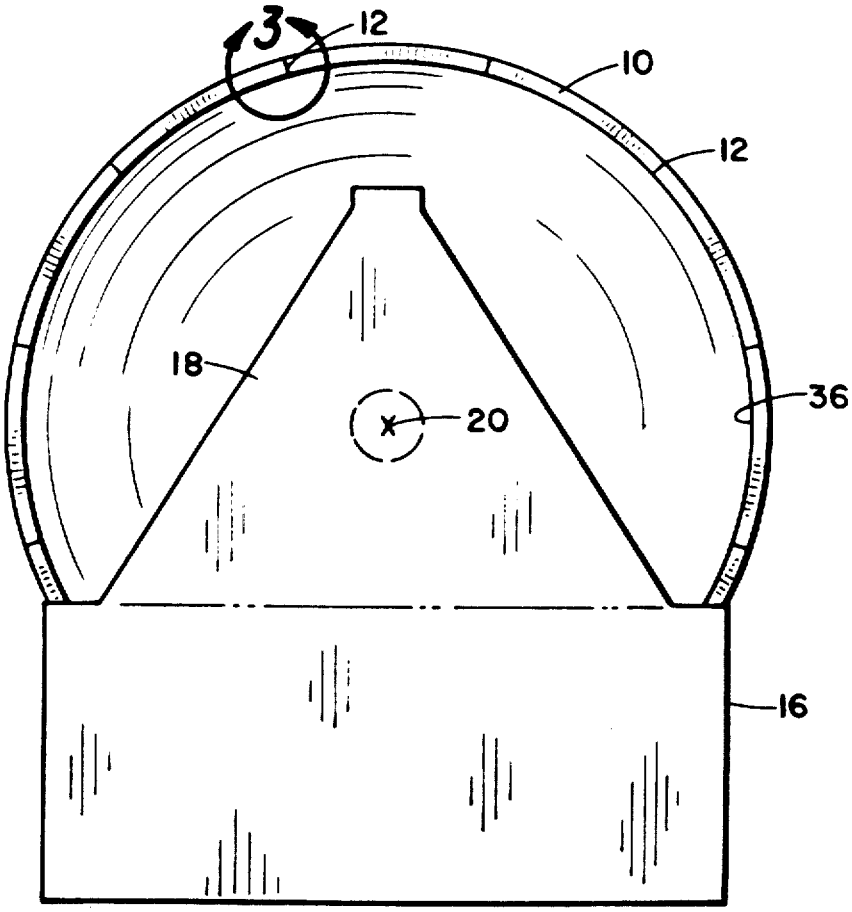
FIG. 2 is a cross section of the structure of FIG. 1 taken along line 2—2 of FIG. 1, near the horizonal, mid-diameter plane of the dome.

FIG. 2 is a cut-away cross sectional view at line 2—2 of FIG. 1. This illustrates how the floor of the rectangular building 14 juts outwardly into the dome structure 13 forming a peninsula 18. Mounted on peninsula 18 is a viewing area 20 which is at the focal point of the curvature of the dome 13. This viewing area 20 may be a cockpit, a ships control room, or other devices to be used in simulation.

Figure 3:
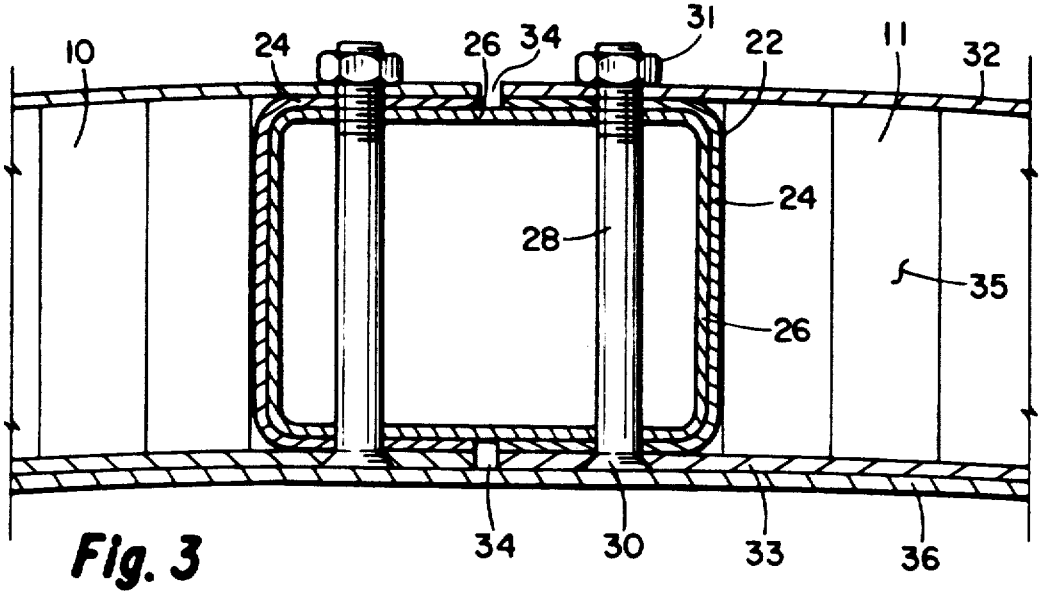
FIG. 3 is a detailed cut away view of the joint structure at 3 of FIG. 2.
Figure 4:
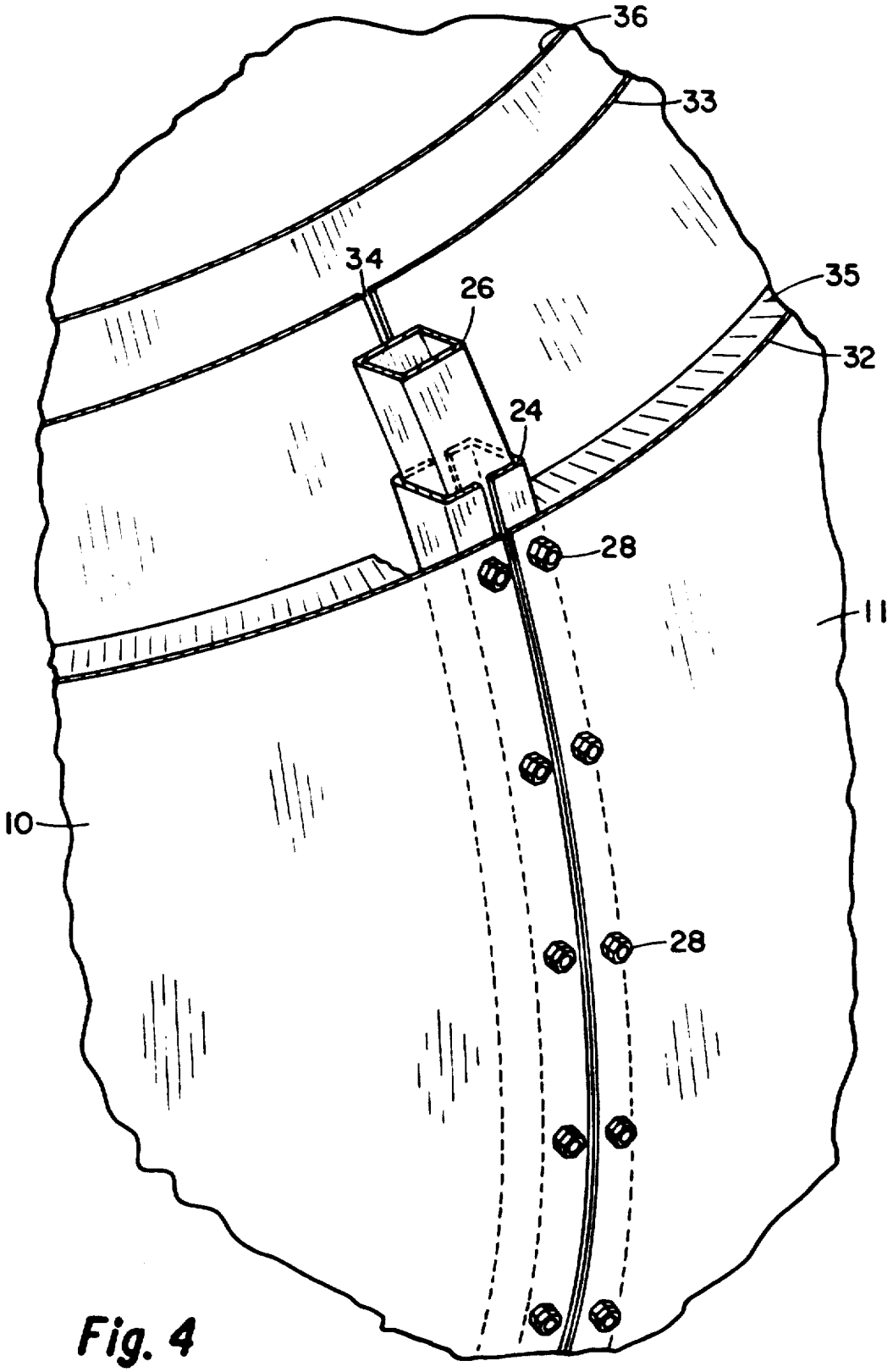
FIG. 4 is an isometric view of the detailed joint in FIG. 3.

FIG. 3 is a detailed section of the joint/seam 12 at area 3 in FIG. 2. FIG. 4 illustrates this in an isometric view. These figures illustrate how panel 10 and panel 11 are joined at seam 12. Each panel 10 and 11 has an outer shell or skin 32 and an inner shell or skin 33 which encloses the body of the panel 35. Any type of panel may be used, such as composite panels, solid panels, hollow panels, cavitated panels, honeycomb panels or other suitable paneling.

The side edges of each gore-shaped panel 10 and 11 have a groove 22 formed therein best seen in FIG. 3, extending from the lower end 19 of the panel 10, 11 to the upper end 17 thereof. This groove 22 is shown in FIGS. 3 and 4 and in the embodiment shown has a composite liner 24. The grooves 22 may be of other shapes, and may be discontinuous. Other lining materials may be used. In solid panels, no liner may be necessary in the grooves 22.

A joining member 26 is placed in the grooves 22 of adjacent panels 10 and 11, and is retained therein by a fastening means, such as a bolt 28. The head 30 of bolt 28 is countersunk so that it is flush with the surface of the inner shell of skin 33. Nut 31 on each bolt is preferably of the locking type. This preserves the smooth surface of the inner shell 33. The joining member 26 is extruded metallic box-channel in the embodiment illustrated herein. The joining member 26 may be solid or hollow, and may be formed of metal, plastic, wood, or other suitable materials, and joining member 26 may be continuous along each side of panels 10 and 11, or it may be in discrete segments. This embodiment uses a bolt 28 as the fastening means. Other fastening means such as rivets, adhesives, interlocking parts on the joining member 26 that fit with receptive areas in grooves 22, or other suitable means may be used.

When panels 10 and 11 are joined, as described above, the inner surface of the shell or skin 33 of panels 10 and 11 are even on each side of joint 12. In the preferred embodiment, a gap 34 is left between the edges of the joined panels 10 and 11 which is filled with a bonding or sealing agent which provides some flexibility in the joint 12. However, joint 12 may be constructed so that no gap 34 is present between the panels, forming a continuous surface.

Once a series of panels 10 and 11 are joined and the dome structure 13 assembled, a presentation surface 36, suitable for projecting pictures thereon, may be applied to the inner shell 33 surface of panels 10 and 11. The presentation surface 36 may be a membrane or sheet attached to the inner surface 33 of the dome 13 by any suitable means, or it may be a coating applied by painting, spraying or the like. Alternatively, the panels 10 and 11 may be preformed with a suitable presentation surface 36 already thereon.

The method of joining panels by using groove 22 and joining member 26 may be used to construct other parts of the structure other than the dome 13, such as the rectangular building 14, or the connection joints 40 between the dome 13 and the rectangular part 14. To achieve these latter connections, the joining member 26 may be formed in various shapes, such as V-shaped, L-shaped, or the like (not shown).

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only the scope of the attached claim or claims, including the full range of equivalency to which each element thereof is entitled.

What is claimed is:

1. A dome-shaped structure comprising:

a plurality of curved gore-shaped construction panels with a groove in each side thereof;

a joining member suitable for insertion within said grooves in each of adjacent panels; and means for securing said joining member within said grooves of adjacent panels wherein said joining of said panels results in the adjacent edges of said curved panels being level with each other forming a smooth surface on the interior of said dome shaped structure.

2. The structure, as described in claim 1, wherein said groove is continuous along the side edges of each curved construction panel.

3. The structure, as described in claim 2, wherein said joining member is continuous for the length of each groove in each side of said curved construction panels.

4. The structure, as described in claim 1, wherein said joining member is a plurality of discrete members spaced along the length of the side edge of each curved construction panel, and within the grooves therein.

5. The structure, as described in claim 1, wherein said means for securing said joining member includes a plurality of countersunk bolts which pass through said curved construction panel and through said joining member securing said joining member in said groove of said panel.

6. The structure, as described in claim 1, wherein said joined panels are separated by a gap between the sides thereof and wherein said gap is filled with a flexible sealing agent.

7. The structure, as described in claim 1, wherein a presentation surface is placed on the inner surface of said dome.

8. A method of constructing a dome-shaped structure using curved construction panels, comprising the steps of:

forming a groove in the edge of each side of each panel;

placing a joining member in said grooves of adjacent panels; and securing said joining members in said grooves, wherein said joining of said panels results in the adjacent edges of said curved panels being level with each other forming a smooth surface on the interior of said dome-shaped structure.

9. The method, as described in claim 8, wherein said smooth surface is covered by placing a presentation surface thereon.

10. A dome-shaped structure comprising:

a plurality of curved gore-shaped construction panels having a front and a back with a continuous groove in each side edge of each panel;

a plurality of joining members formed of rectangular tubular material inserted into the grooves of adjacent curved panels thereby joining said panels together so that the panel surfaces of adjacent panels are level with each other and wherein said joining of said panels results in the adjacent edges of said curved panels being level with each other forming a smooth surface on the interior of said dome-shaped structure;

a plurality of countersunk bolts extending from the front of said panels through said joining members and thence through the back of said panels thus securing said joining members in said grooves; and a presentation surface placed over the inner surface of said dome after joining said panels.

11. The structure, as described in claim 10, wherein said joining of panels leaves a gap between the side edges thereof and includes a resilient sealing material within said gap.

* * * * *